US007963278B2

(12) United States Patent
Makowski

(10) Patent No.: US 7,963,278 B2
(45) Date of Patent: Jun. 21, 2011

(54) APPARATUS FOR DEPLOYING A BOLA

(76) Inventor: Gary G. Makowski, Huntsville, AL (US)

( * ) Notice: Subject to any disclaimer, the term of this patent is extended or adjusted under 35 U.S.C. 154(b) by 387 days.

(21) Appl. No.: 12/277,976

(22) Filed: Nov. 25, 2008

(65) Prior Publication Data

US 2010/0126483 A1 May 27, 2010

(51) Int. Cl.
*F41F 7/00* (2006.01)

(52) U.S. Cl. ..... 124/5; 124/41.1; 124/83

(58) Field of Classification Search ..... 124/1, 4, 124/5, 41.1, 83, 85; 446/473, 486, 487; 273/343; 473/505
See application file for complete search history.

(56) References Cited

U.S. PATENT DOCUMENTS

| | | | | |
|---|---|---|---|---|
| 442,675 | A * | 12/1890 | Wilcox | 473/514 |
| 1,304,857 | A * | 5/1919 | Davis | 89/14.05 |
| 2,120,075 | A * | 6/1938 | Roosman | 473/514 |
| 2,797,924 | A * | 7/1957 | Stewart | 273/343 |
| 3,049,352 | A * | 8/1962 | Hancock | 473/514 |
| 3,115,129 | A * | 12/1963 | Merriman | 124/5 |
| 5,377,995 | A * | 1/1995 | Clark | 473/514 |
| 5,522,597 | A * | 6/1996 | Hanks | 473/514 |
| 5,624,295 | A * | 4/1997 | Watkins | 446/475 |
| 6,381,894 | B1 * | 5/2002 | Murphy | 42/77 |
| 6,692,335 | B2 * | 2/2004 | Watkins | 446/475 |
| 2005/0269784 | A1 | 12/2005 | Peters | |
| 2006/0094573 | A1 | 5/2006 | Weck | |
| 2008/0048397 | A1 | 2/2008 | Mancini | |

FOREIGN PATENT DOCUMENTS

| | | |
|---|---|---|
| WO | WO9404235 | 3/1994 |

* cited by examiner

*Primary Examiner* — Gene Kim
*Assistant Examiner* — Scott Young
(74) *Attorney, Agent, or Firm* — George P. Kobler; Lanier Ford Shaver & Payne, PC

(57) ABSTRACT

An apparatus for deploying a bola comprises a hollow outer cylinder slidably housing a hollow inner cylinder. The inner cylinder includes one closed end and houses a payload consisting of a bola consisting of three weights connected by cords, and spacers interposed between said weights.

20 Claims, 3 Drawing Sheets

APPARATUS FOR DEPLOYING A BOLA

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

The various embodiments of the present invention and their advantages are best understood by referring to FIGS. 1 through 6 of the drawings. The elements of the drawings are not necessarily to scale, emphasis instead being placed upon clearly illustrating the principles of the invention. Throughout the drawings, like numerals are used for like and corresponding parts of the various drawings.

The drawings represent and illustrate examples of the various embodiments of the invention, and not a limitation thereof. It will be apparent to those skilled in the art that various modifications and variations can be made in the present invention without departing from the scope and spirit of the invention as described herein. For instance, features illustrated or described as part of one embodiment can be included in another embodiment to yield a still further embodiment. Moreover, variations in selection of materials and/or characteristics may be practiced to satisfy particular desired user criteria. Thus, it is intended that the present invention covers such modifications as come within the scope of the features and their equivalents.

Furthermore, reference in the specification to "an embodiment," "one embodiment," "various embodiments," or any variant thereof means that a particular feature or aspect of the invention described in conjunction with the particular embodiment is included in at least one embodiment of the present invention. Thus, the appearance of the phrases "in one embodiment," "in another embodiment," or variations thereof in various places throughout the specification are not necessarily all referring to its respective embodiment.

Figure 1:
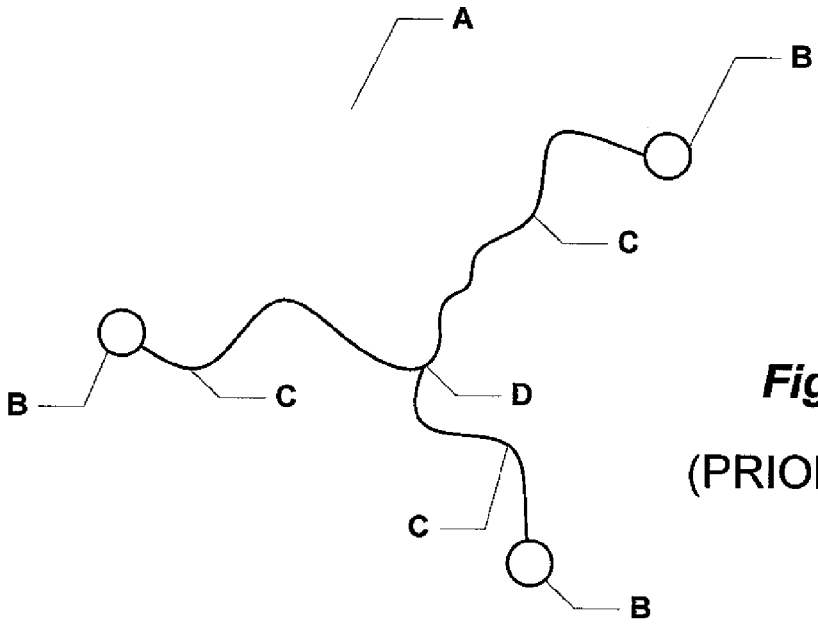
Fig.1 (PRIOR ART)
FIG. 1 depicts a three-weighted bola as is known in the prior art.
Figure 2:
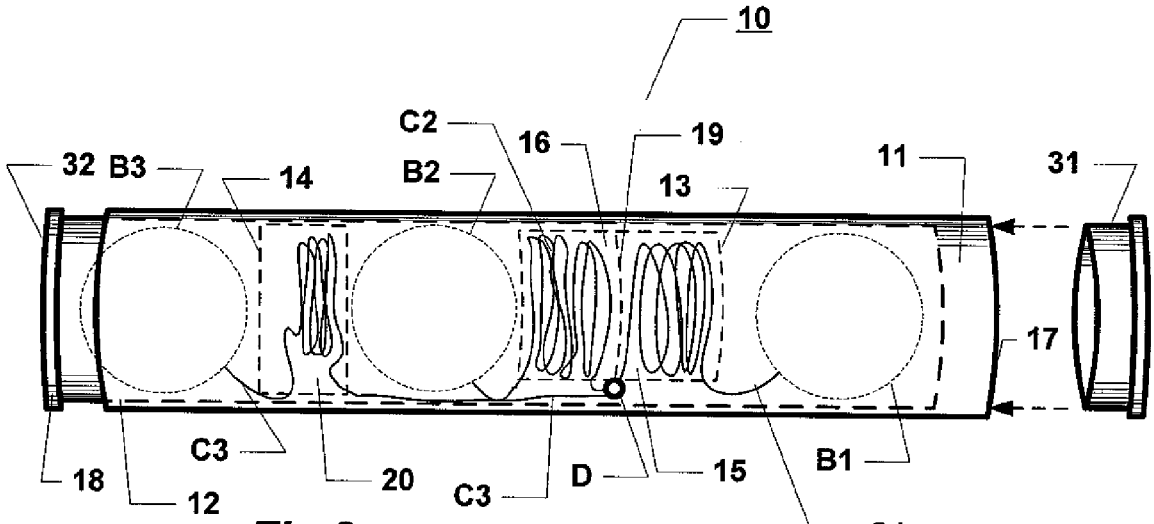
FIG. 2 illustrates an exemplary embodiment of an apparatus for deploying a bola.

FIG. 1 illustrates a three-weighted bola A as is known in the prior art comprising three weights B connected to three ends of a set of cords C that are themselves mutually interconnected at a nexus D. FIG. 2, depicts an apparatus, generally at 10, including a hollow outer cylinder 11 having two open ends, with a hollow inner cylinder 12 slidably inserted therein. Inner cylinder 12 is formed with slightly smaller diameter than outer cylinder 11, and includes one closed end 32 an annular flange 18 extending from the circumference of one end radially to a diameter greater than the inner diameter of the outer cylinder 11 to prevent the inner cylinder 12 from passing completely trough the outer cylinder 11. Outer cylinder 11 includes an open end 17 opposing the end where the inner cylinder 12 closed end 32 is located. A cap 31 may be included to close the open end 17.

Inside the inner cylinder 12 is stowed first, second and third weights B1, B2, and B3, of a prior art bola, attached to ends of cords C1, C2 and C3. Cords C are interconnected at nexus D. Interposed between first and second weights B1, B2 is a first spacer 13, and interposed between second and third weights B2, B3 is a second spacer 14. First spacer 13 is hollow with divider 19 forming end-most chamber 15, and middle chamber 16.

Cord C1 extends from first weight B1 and is gathered inside the end-most chamber 15 with an end extending from the chamber 15 to connect with nexus D, and cord C2 extends from second weight B2 and is gathered inside middle chamber 16 with an end extending from the chamber 16 to connect with nexus D. Nexus D is disposed outside the respective chambers. Cord C3 extends from a connection to nexus D to second spacer 14. Second spacer 14 is also hollow defining a single chamber 20 in which cord C3 is gathered therein with an end extending from the chamber 20 to connect with the third weight B3. It will be appreciated that positions of the spacers 13, 14 may be swapped still be within the scope of the invention.

Figure 3:
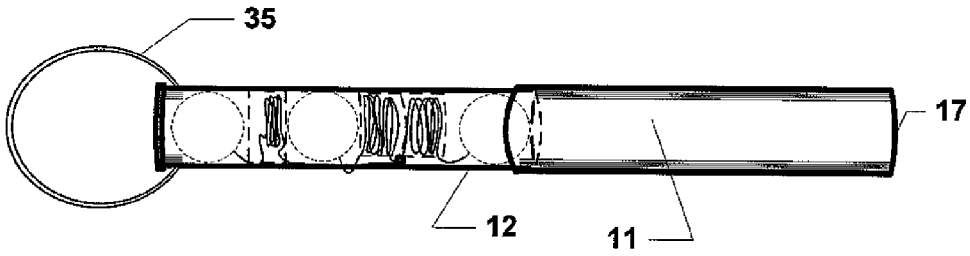
FIG. 3 illustrates the embodiment of FIG. 2 in an extended position.
Figure 5:
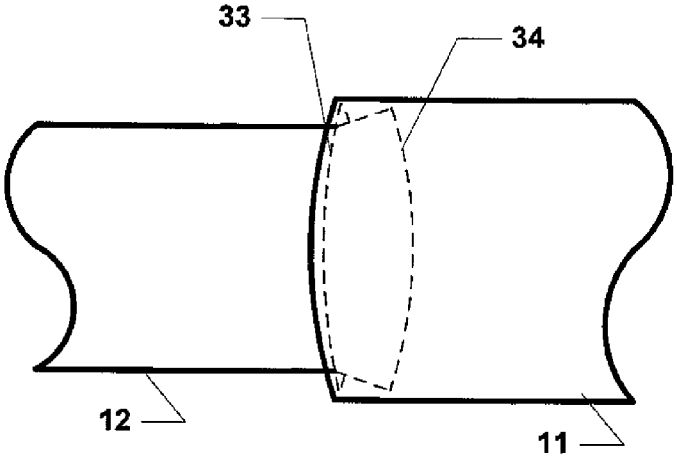
FIG. 5 is a detailed view of the engagement of the two housing components.

FIG. 3 depicts the apparatus in an extended position where inner cylinder 12 is extended longitudinally with respect to the outer cylinder 11. Also shown in FIG. 3 is an optional lanyard 35 connected to the closed end 32 to form a loop for hanging the apparatus on a belt. FIG. 5 shows in detail an exemplary configuration of the respective inner and outer cylinders 12, 11 that prevents the outer cylinder 11 from becoming entirely disengaged from the inner cylinder 12 when extending the respective cylinders. Inner cylinder 12 includes an open end 34, which is housed within the outer cylinder, and is somewhat flared, i.e., the inner cylinder has a portion with a constant diameter and the portion housed within outer cylinder 11 increases in diameter approaching the end 34. The outer cylinder may be configured with a centrally extending lip 33. The diameter of the inner cylinder end 32 increases to a diameter greater than that of the lip 33. Thus, the inner cylinder 12 is retained in engagement with the outer cylinder 11

From the extended position shown in FIG. 3, the bola is deployed by grasping the inner cylinder 12 and slinging the apparatus toward a target. The centrifugal force generated by the slinging motion impels the weights B1, B2, and B3 and the spacers 13, 14 out of the open end of the outer cylinder 11. Once the weights exit the cylinder 11 the bola rotates causing the weights to extend further from the nexus and, thus, the cords C1, C2, and C3 to straighten. As the cords straighten, the gathered portions are pulled from the chambers of the spacers 13, 14. Accordingly, it would be preferable for the cords to be gathered in the chamber in such a way as to avoid tangling within the chambers, preventing the cords from separating from the spacers 13, 14.

Figure 4A:
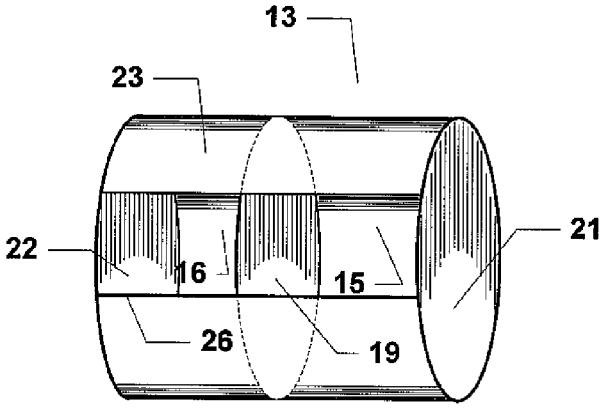
FIG. 4A depicts an exemplary spacer with two chambers.
Figure 4B:
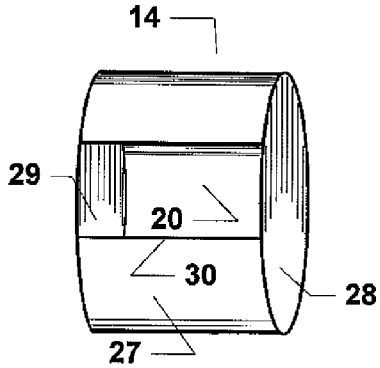
FIG. 4B depicts an exemplary spacer with one chamber.

FIGS. 4A and 4B illustrate exemplary spacers 13, 14. FIG. 4A shows a two-chamber spacer 13. Two chamber spacer 13 includes opposing end caps 21, 22, a wall 23 in which is defined a longitudinal aperture 26 and a divider 19, defining an end most chamber 15 and a middle chamber 16. Similarly, FIG. 4B depicts an exemplary one chamber spacer 14, including a wall 27 with two end caps 28, 29 that define a chamber 20. A longitudinal aperture 30 is formed in wall 27.

Figure 6:
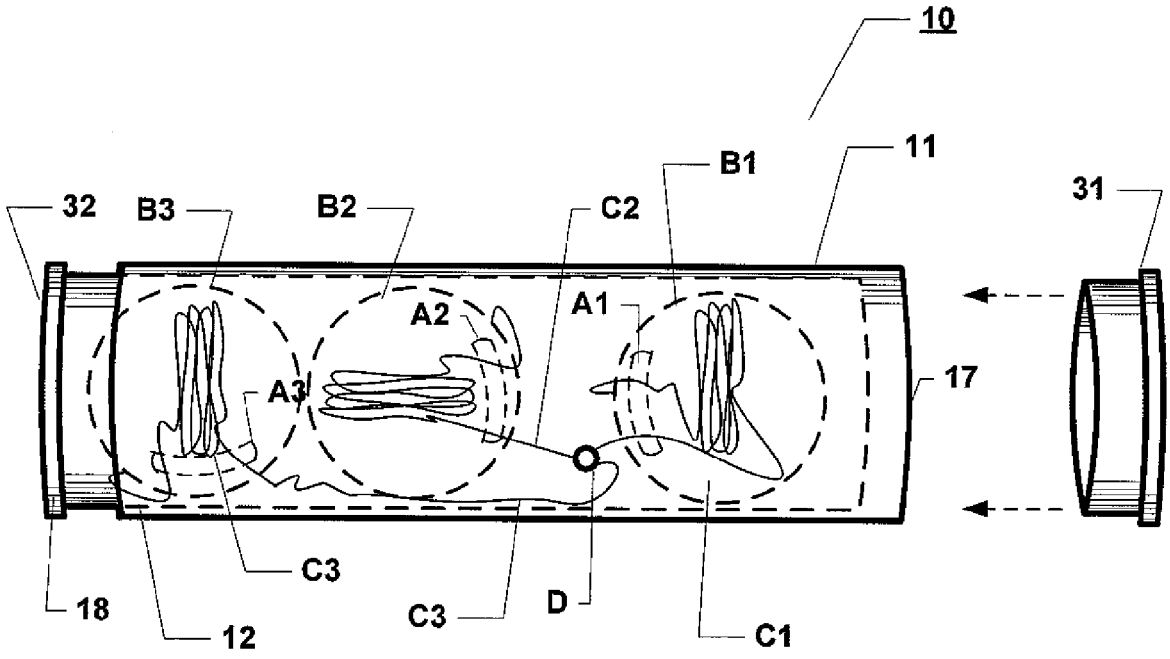
FIG. 6 illustrates another exemplary embodiment of an apparatus for deploying a bola.

FIG. 6 depicts another exemplary embodiment where inner and outer cylinders 12, 11 are shorter than in the above-described version. In this case, spacers of the previous embodiment are removed, and weights B1, B2, B3 are each configured to define an interior chamber with an aperture A1, A2, A3 defined in the surface of the weight B to open to the chamber. Cords C1, C2, C3 each have one end attached to an outer surface of each respective weight B1, B2, B3 and another end attached to nexus D. The interposing lengths of each cord C is stored within the respective chambers defined in the respective weights B. When deploying the bola, as weights B1, B2, B3 exit the cylinder 11 opening 17, momentum causes each weight to separate with respect to the nexus D, thus, causing the lengths of each cord C to be drawn out from the chambers.

As described above and shown in the associated drawings, the present invention comprises an apparatus for deploying a bola. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. An apparatus for deploying a bola, said bola being comprised of first, second and third weights attached to respective ends of first, second and third cords, said cords, mutually interconnected at a nexus, said apparatus comprising:

a hollow outer cylinder having a diameter and first and second open ends;

an inner cylinder slidably housed within outer cylinder and extending from said first open end, said inner cylinder having a third open end and a closed end, said closed end including a circumferentially disposed flange extending to a diameter greater than the inside diameter of said outer cylinder; and a payload stowed within said inner cylinder comprising said bola and first and second spacers for housing said cords, said first spacer being interposed between said first and second weights and having a wall in which an aperture is formed and first and second chambers defined therein, and said second spacer being interposed between said second and third weights and having a wall in which an aperture is formed therein and defining a third chamber, wherein said first, second and third cords are housed within said first, second and third chambers, respectively.

2. The apparatus for deploying a bola as in claim 1, further comprising a cap closing said second open end of said hollow outer cylinder.

3. The apparatus for deploying a bola as in claim 2, further comprising a lanyard connected to said closed end of said inner cylinder.

4. The apparatus for deploying a bola as in claim 1, wherein said outer cylinder further comprises a circumferential lip extending radially inward about said first open end, and wherein said inner cylinder third open end is flared to engage said lip.

5. The apparatus for deploying a bola as in claim 4, further comprising a cap closing said second open end of said hollow outer cylinder.

6. The apparatus for deploying a bola as in claim 5, further comprising a lanyard connected to said closed end of said inner cylinder.

7. An apparatus comprising:

a hollow outer cylinder having a diameter and two open ends;

an inner cylinder slidably housed within said outer cylinder and having an open end and a closed end, said closed end including a circumferentially disposed flange extending to a diameter greater than the inside diameter of said outer cylinder; and a payload stowed within said inner cylinder comprising a bola having first, second and third weights attached to respective ends of first, second and third cords, said cords, mutually interconnected at a nexus.

8. The apparatus of claim 7, wherein said payload further comprises first and second spacer members, said first spacer member being interposed between said first and second weights and having a wall in which an aperture is formed and first and second chambers defined therein, and said second spacer member being interposed between said second and third weights and having a wall in which an aperture is formed therein and defining a third chamber, wherein said first, second and third cords are housed within said first, second and third chambers, respectively.

9. The apparatus of claim 8, further comprising a cap closing one of said open ends of said hollow outer cylinder.

10. The apparatus of claim 9, further comprising a lanyard connected to said closed end of said inner cylinder.

11. The apparatus of claim 7, wherein said each of said weights includes an aperture defined in a surface of said weight, said aperture in communication with an interior chamber defined within each said weight.

12. The apparatus of claim 7, wherein said outer cylinder further comprises a circumferential lip extending radially inward about said first open end, and wherein said inner cylinder third open end is flared to engage said lip.

13. The apparatus of claim 12, wherein said payload further comprises first and second spacer members, said first spacer member being interposed between said first and second weights and having a wall in which an aperture is formed and first and second chambers defined therein, and said second spacer member being interposed between said second and third weights and having a wall in which an aperture is formed therein and defining a third chamber, wherein said first, second and third cords are housed within said first, second and third chambers, respectively.

14. The apparatus of claim 13, further comprising a cap closing one of said open ends of said hollow outer cylinder.

15. The apparatus of claim 14, further comprising a lanyard connected to said closed end of said inner cylinder.

16. The apparatus of claim 7, wherein said each of said weights includes an aperture defined in a surface of said weight, said aperture in communication with an interior chamber defined within each said weight.

17. The apparatus of claim 16, further comprising a cap closing one of said open ends of said hollow outer cylinder.

18. The apparatus of claim 17, further comprising a lanyard connected to said closed end of said inner cylinder.

19. The apparatus of claim 16, wherein said outer cylinder further comprises a circumferential lip extending radially inward about said first open end, and wherein said inner cylinder third open end is flared to engage said lip.

20. The apparatus of claim 19, further comprising a cap closing one of said open ends of said hollow outer cylinder and a lanyard connected to said closed end of said inner cylinder.

* * * * *